United States Patent [19]

Conery et al.

[11] 4,108,386

[45] Aug. 22, 1978

[54] GRINDER PUMP

[75] Inventors: William J. Conery; Terry L. Kiplinger, both of Ashland, Ohio

[73] Assignee: McNeil Corporation, Akron, Ohio

[21] Appl. No.: 787,081

[22] Filed: Apr. 13, 1977

[51] Int. Cl.[2] ..... B02C 18/40

[52] U.S. Cl. ..... 241/46.11; 241/185 A

[58] Field of Search ..... 241/46 R, 46.02, 46.06, 241/46.11, 46.17, 185 A; 417/424

[56] References Cited

U.S. PATENT DOCUMENTS

| | | | |
|---|---|---|---|
| 2,598,484 | 5/1952 | Adams | 417/424 |
| 3,650,481 | 3/1972 | Conery et al. | 241/46.11 |
| 3,726,486 | 4/1973 | Smith et al. | 241/46.11 |
| 3,738,581 | 6/1973 | Gallauresi et al. | 241/46.02 |
| 3,936,221 | 2/1976 | Lobanoff | 417/424 |
| 3,938,744 | 2/1976 | Allen | 241/46.11 |

*Primary Examiner*—Granville Y. Custer, Jr.

*Attorney, Agent, or Firm*—Hamilton, Renner & Kenner

[57] ABSTRACT

A pump for grinding materials contained in a liquid includes a comminutor located at the pump inlet to grind the material as it passes therethrough and into a pumping chamber. The pumping action is created by an impeller which communicates with the pumping chamber but which is located outside thereof to draw the material through the comminutor and into the chamber for radial discharge therefrom. The comminutor includes a stationary annular ring in the inlet having a plurality of grinding teeth which form the internal diameter of the ring. A cutting impeller is rotatable within the ring and has at least one blade which extends from one side of the impeller body axially outwardly beyond the ring to force the material between the teeth of the ring. The other side of the impeller body is provided with means to provide additional shearing of the material and prevent clogging of the material between the teeth of the ring.

13 Claims, 3 Drawing Figures

GRINDER PUMP

BACKGROUND OF THE INVENTION

This invention relates to a device for grinding materials in a liquid and pumping the same from a basin. More particularly, this invention relates to a device which will efficiently grind large materials into a fine slurry without clogging through a unique pumping and comminutor arrangement.

In the prior art of which we are aware, material to be ground and disposed of is entrained in a liquid and drawn axially into a pump chamber through a comminutor. The motive force for the pumping action is typically an impeller mounted in the pump chamber which centrifugally throws the ground material and liquid through a radial discharge. However, with the impeller situated in the chamber, it often promotes clogging of the material both behind the comminutor and on the impeller itself which tends to bind the same, thus reducing pump efficiency. Such impellers are also often used to provide secondary shearing which too hinders their pumping efficiency. In addition, such a positioned impeller requires close running clearances, thus adding to the cost of precision manufacturing.

The comminutors of the prior art usually consist of a stationary cutting ring positioned in the pump inlet and having cutting teeth or blades on the internal face thereof. An impeller disk having an external diameter generally corresponding to the internal diameter of the ring is rotated within the ring. The disk usually is provided with a plurality of cutting blades with the entire unit being positioned totally within the axial extent of the ring. Ideally, the material is supposed to be cut by the blade and drawn through the small openings between the cutting teeth of the ring and the outer edge of the disk to be further cut by the pump impeller in the pump chamber and subsequently radially discharged out of the chamber. Unfortunately larger materials, such as large rags, tend to wind around the cutting blades on the disk and/or clog the small passages between the cutting teeth on the ring. The smaller or more fiberous materials, such as disposable diapers, usually will pass through the passages but will tend to wad up behind the impeller disk. Thus, the prior art designs do not efficiently handle all types of materials which may be encountered.

In addition, in these prior art designs with the blades positioned entirely within the axial extent of the cutting ring, grease or other coagulants, when mixed with the solids to be ground, tend to build up on the pumping and cutting surfaces thereby clogging the same. Similarly, hard objects, such as wire, often lodge between the cutting blade and teeth on the ring thereby locking the motor shaft.

SUMMARY OF THE INVENTION

It is thus a primary object of the present invention to provide a device which efficiently accepts and grinds a wide variety of materials regardless of size or makeup.

It is another object of the present invention to provide a device, as above, which includes a comminutor having a rotatable disk, the blades of which extend below the edge of the cutting ring to cut and propel the material through the teeth of the cutting ring thereby preventing clogging of the same.

It is another object of the present invention to provide a device, as above, which because the blades extend below the cutting ring, will efficiently pass grease and other coagulants by providing a scouring action on the pumping device and basin walls thereby reducing maintenance problems and preventing clogging of the cutting surfaces.

It is yet another object of the present invention to provide a device, as above, which because the blades extend below the cutting ring, will efficiently operate on hard objects propelling the same away from the suction thereby eliminating damage to the comminutor and operating motor.

It is a further object of the present invention to provide a device, as above, which includes a comminutor having a rotatable disk with means therein which prevents wadding of small materials on the back thereof and provides additional pumping action.

It is yet another object of the present invention to provide a device, as above, in which the pump chamber is not impaired by the presence of the pump impeller.

It is still another object of the present invention to provide a device, as above, in which the pump impeller is not utilized for any shearing action thereby improving the overall efficiency thereof.

It is an additional object of the present invention to provide a device, as above, in which the pump impeller does not have close running tolerances.

These and other objects of the present invention, which will become apparent from the description of the preferred embodiment, are accomplished by means hereinafter described and claimed.

In general, the grinder pump according to the present invention includes a pump chamber having an axial inlet thereto. A rotatable shaft extends axially through the chamber and into the inlet. A pump impeller is mounted on the shaft outside of but communicating with the chamber. A comminutor assembly is located in the inlet so that as material is drawn through the inlet and into the pump chamber by the pump impeller, it is finely ground and discharged radially of the chamber. The comminutor assembly includes an annular ring member in the inlet which has a plurality of teeth forming the internal diameter thereof. A cutting impeller is mounted on the shaft within the disk and includes a disk member, the external diameter of which generally corresponds to the internal diameter of the ring. At least one cutting blade extends generally axially outward from one side of the impeller disk to a point beyond the axial extent of the ring. Thus, material is drawn by the pump impeller toward the inlet and in the process is cut by the blades of the cutting impeller and forced through the teeth of the ring. The other side of the impeller disk is provided with means to further shear the material so that as the material passes into the pump chamber, wadding of the same behind the cutting impeller is prevented.

DESCRIPTION OF THE PREFERRED EMBODIMENT

Figure 1:
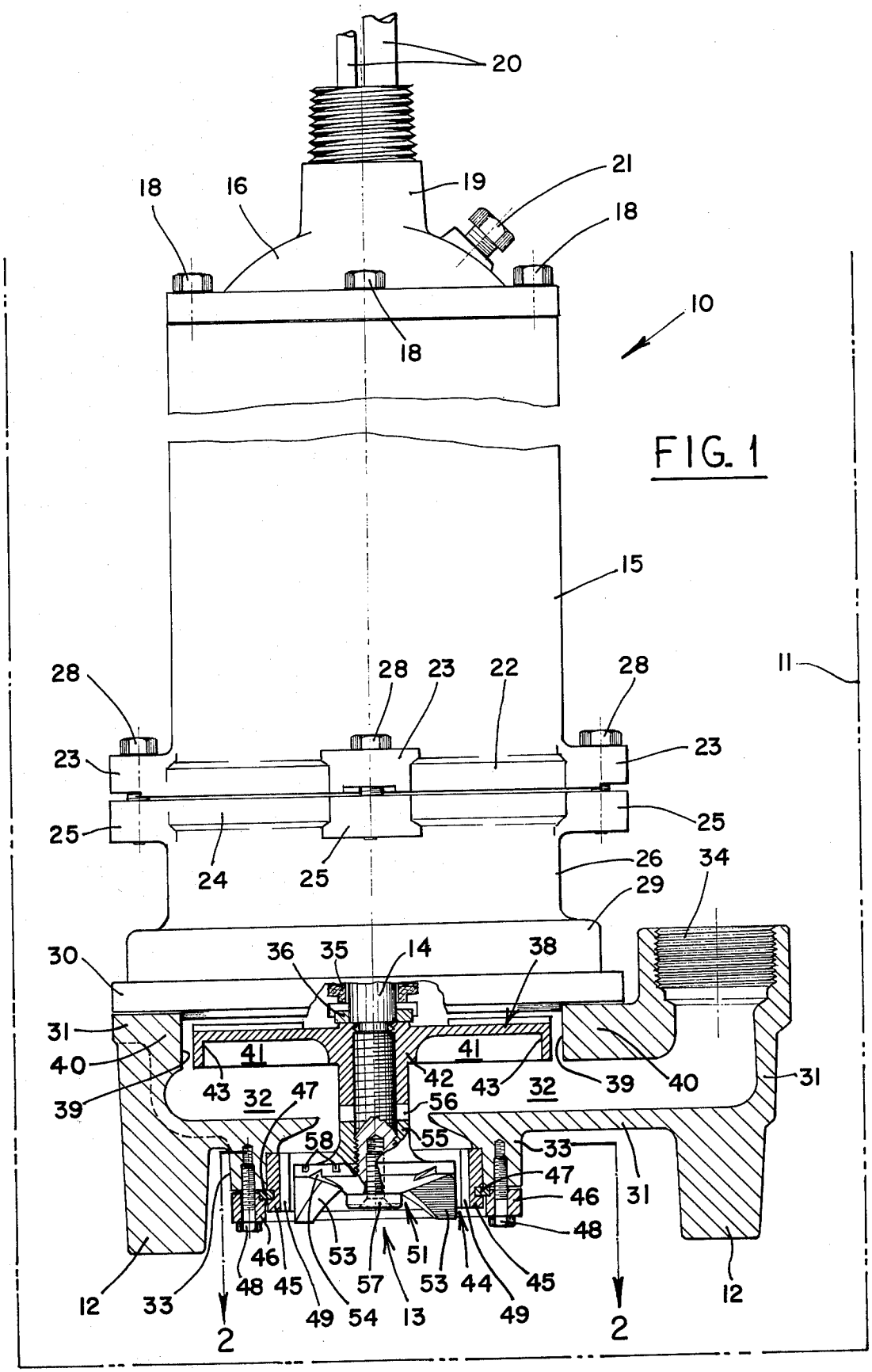
FIG. 1 is a partial elevational and partial vertically sectioned view of the grinder pump according to the concept of the present invention.

A grinder pump according to the preferred embodiment of the present invention is indicated generally by the numeral 10 in FIG. 1 and is adapted to be totally or partially submersed in a sump indicated schematically at 11. Pump 10 is most often suspended in sump 11 by conventional means (not shown) or in some situations can rest on feet 12 on the bottom of the sump. In this regard it is only important that the pump inlet, indicated generally by the numeral 13, be spaced away from the bottom of sump 11 so that fluid and material to be ground can be received in inlet 13. More importantly, feet 12 serve to support the pump in an upright position when maintenance is being performed thereon.

Pump 10 includes a rotatable shaft 14 which is driven by a motor (not shown) sealed in motor housing 15. A cap 16 is affixed to housing 15, as by cap screws 18, and is provided with a hub 19 through which the electrical conductors 20 may pass to drive the motor. Access to the inside of cap 16 may be obtained without detaching the same from motor housing 15 by means of plug member 21.

The lower portion of housing 15 is provided with a flange 22 having lugs 23 projecting therefrom. Flange 22 and lugs 23 sealingly engage flange 24 and lugs 25, respectively, on the upper portion of an oil housing 26, with housing 15 being affixed to housing 26 by cap screws 28. Housing 26 provides a chamber or reservoir for a fluid, such as oil, which isolates the motor from the pumped liquid. The lower portion of housing 26 is flanged, as at 29, for engaging, as by screws (not shown) an annular plate 30 which forms the bottom of the oil reservoir.

A volute pump casing 31 is carried by plate 30 and defines a pumping chamber 32 which may receive the fluid and material as it passes axially through inlet 13. Casing 31 includes axially directed flanges 33 which generally define the inlet 13 thereto. Fluid is transferred radially through chamber 32 and then upwardly through an output port 34. Additional piping (not shown) can be attached to port 34 so that the fluid and material can be transferred out of sump 11. Casing 31 also carries feet 12 previously described.

Rotatable shaft 14 extends through housing 15, housing 26 and plate 30, with appropriate fluid seals, such as at 35 and 36, being provided at the various junctures, and is threaded at its lower end. A pump impeller, generally indicated by the numeral 38, is threaded onto shaft 14 into a recess 39 formed outside of pumping chamber 32 as defined by portions 40 of pump casing 31. Impeller 38 includes a plurality of blades 41 extending from a hub portion 42. An annular axially directed ring 43 is formed at the periphery of the blades. Thus, although impeller 38 is recessed outside of chamber 32, its blades 41 and other pumping surfaces are in full communication with the fluid and material in chamber 32 so that fluid is drawn in through inlet 13, which is situated on the side of chamber 32 opposed to impeller 38, and discharged radially through chamber 32.

Figure 2:
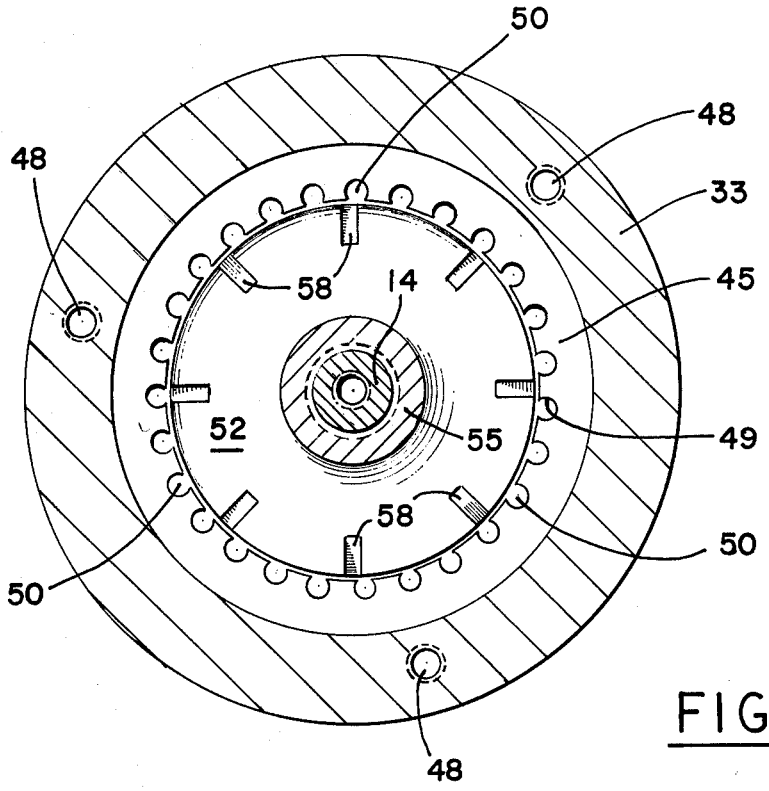
FIG. 2 is a sectional view taken substantially along line 2—2 of FIG. 1.

In order to grind or otherwise pulverize the material in the fluid, a comminutor, generally indicated by the numeral 44, is provided in inlet 13. As shown in FIGS. 1 and 2, a comminutor or grinder ring 45 is locked in place by means of an annular clamp ring 46 with a snap or lock ring 47 held in place by cap screws 48 extending into the axially directed flanges 33 of casing 31. The radially inner surface of ring 45 is provided with a plurality of grinder teeth 49 which consist of relatively evenly spaced axially directed apertures 50 best shown in FIG. 2.

Figure 3:
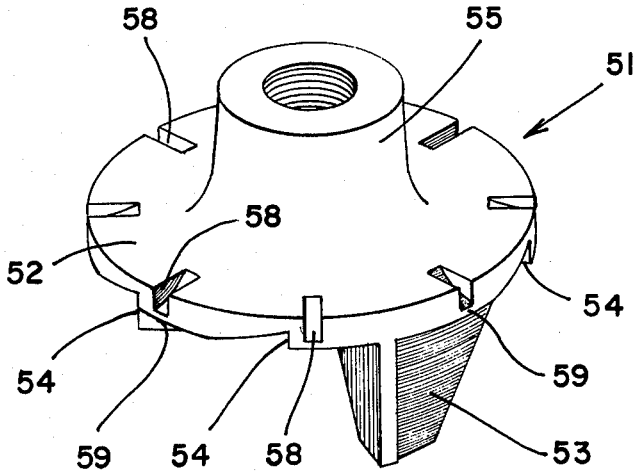
FIG. 3 is a perspective view of the comminuting impeller according to the concept of the present invention.

Comminutor 44 also includes a grinding impeller generally indicated by the numeral 51. As best shown in FIGS. 2 and 3, grinding impeller 51 includes a disk-like or annular imperforate body member 52 having an external diameter generally corresponding to the internal diameter of ring 45 and having a plurality of blades 53 extending generally axially from the inlet side of disk 52. Blades 53 extend axially out of the inlet beyond the axial extent of ring 45 so that material in the sump is picked up and thrown against the cutting ring 45. Additional cutting action is obtained in that the axially outer surface of disk 52 is provided with serrations 54. Grinding impeller 51 also includes, on the side of disk member 52 facing pump chamber 32, a hub portion 55 which is adapted to be threaded onto shaft 14. A spacer or washer 56 can be utilized to separate the hub portion 55 of grinding impeller 51 from an extension of the hub portion 42 of pump impeller 38. The axial end of shaft 14 is bored to receive a retaining bolt 57 to hold impeller 51 thereon.

On the side of disk member 52 facing pump chamber 32 and opposed to blades 53, there are provided a plurality of generally radially directed slots 58 machined therein. These slots are machined at an angle relative to horizontal but do not extend entirely axially through disk member 52 thus leaving a lip portion 59 in the disk member. As impeller 51 rotates with shaft 14, slots 58 provide additional shearing action as the material passes through inlet 13 toward pumping chamber 32. This shearing action is primarily created by the sharp corners which define slots 58. In addition, slots 58 tend to provide an additional pumping force on the fluid as it passes thereby.

In summary as to the operation of grinder pump 10, materials placed in sump 11 are drawn by the pumping of impeller 38 toward inlet 13. Larger materials are first caught and sheared by blades 53 and thrown outward toward grinder ring 45. Because the blades extend axially below the cutting ring, clogging of inlet 13 is prevented and all material is ground to a size such that it may pass through the small openings 50 in ring 45. Grease and other coagulants are scoured away and hard materials, such as wire, is thrown away from the pump inlet. The close tolerance between the outer diameter of disk member 52 of grinding impeller 51 and the inside diameter of ring 45 essentially limits inlet communication to pump chamber 32 solely to the openings 50 in ring 45.

As the material passes through these openings, slots 58 will further shear the material to prevent wadding up of the material behind the impeller. Slots 58 will also provide some additional pumping action so that with the action of impeller 38, the material passes axially into chamber 32 to be discharged radially therethrough and then upwardly through output port 34. Because impeller 38 is recessed totally outside of chamber 32, it will in no way impede the flow of material or otherwise be clogged by the material.

The above described grinder pump has been found to grind and dispose of heavy materials such as large rags, towels, blankets and other bulky items, without clogging, primarily due to the relative axial location of blades 53 with respect to ring 45. In addition, smaller and more fiberous materials such as facial tissue, disposable diapers and the like will not clog up behind impeller 51 primarily due to the shearing and agitation of slots 58.

It should thus be evident that a grinder pump constructed as described herein accomplishes the objects of the present invention and otherwise improves the grinder pump art.

What is claimed is:

1. A grinder pump comprising an axial inlet, a pumping chamber communicating with said inlet, a rotatable shaft extending axially through said chamber and into said inlet, pump impeller means on said shaft outside of but communicating with said chamber, annular ring means in said inlet having teeth forming the internal diameter thereof, impeller means on said shaft and rotatable therewith within said ring means, said impeller means including a disk member the external diameter of which generally corresponds to the internal diameter of said ring means, and at least one blade member extending generally axially of said disk member out of said inlet further than the axial extent of said ring means so that upon rotation of said shaft said pump impeller draws material through said teeth of said ring means and into said chamber for discharge therefrom.

2. A grinder pump according to claim 1 wherein said pump impeller means includes a hub portion, a plurality of blades extending radially of said hub portion and an annular ring on the periphery of said blades, said blades and rings being wholly outside of said chamber so that upon rotation of said shaft material is drawn axially into said chamber and moved generally radially therethrough for subsequent discharge.

3. A grinder pump according to claim 1 wherein said pump impeller means is located adjacent the side of said chamber opposite to said inlet.

4. A grinder pump according to claim 1 further comprising additional means on the side of said disk member facing said chamber for preventing clogging of the material by shearing the same.

5. A grinder pump according to claim 4 wherein said additional means also provides pumping action in addition to the pumping action of said pump impeller means.

6. A grinder pump according to claim 4 wherein said additional means includes a plurality of slots in said impeller, said slots extending angularly into but not entirely through said disk member.

7. A grinder pump comprising an axial inlet, a pumping chamber communicating with said inlet, a rotatable shaft extending axially through said chamber and into said inlet, pump impeller means on said shaft outside of but communicating with said chamber, annular ring means in said inlet having teeth forming the internal diameter thereof, impeller means on said shaft and rotatable within said ring means, said impeller means including a disk member having an external diameter generally corresponding to the internal diameter of said annular ring means forcing material to pass through said teeth of said ring means and into said chamber for discharge therefrom, and a plurality of generally radially oriented slots in said disk member on the side of said disk member facing said chamber for preventing clogging of the material by shearing the same.

8. A comminutor for a grinder pump comprising ring means having a plurality of teeth forming the internal diameter thereof; and impeller means rotatable within said ring means; said impeller means having a disk member the diameter of which generally corresponds to the internal diameter of said ring means, and at least one cutting blade extending from one side of said disk member axially outward of said ring means to shear the material and throw the same toward said teeth.

9. A comminutor according to claim 8 further comprising means on the other side of said disk member to provide additional shearing of the material.

10. A communitor for a grinder pump comprising ring means having a plurality of teeth forming the internal diameter thereof; and impeller means rotatable within said ring means; said impeller means including a disk member the diameter of which generally corresponds to the internal diameter of said ring means, at least one cutting blade extending from one side of said disk member axially outward of said ring means to shear the material and throw the same toward said teeth, and a plurality of generally radially oriented slots in said disk member on the other side thereof to provide additional shearing of the material.

11. A comminutor according to claim 10 wherein said slots extend angularly into but not entirely through the periphery of said disk member.

12. A comminutor for a grinder pump comprising ring means having a plurality of teeth forming the internal diameter thereof; and impeller means rotatable within said ring means; said impeller means having a disk member the diameter of which generally corresponds to the internal diameter of said ring means so that material is forced to pass through said teeth for shearing action, and a plurality of slots in said disk member on one side thereof to provide additional shearing of the material.

13. A comminutor according to claim 12 wherein said slots extend angularly into but not entirely through the periphery of said disk member.

* * * * *